US007100502B2

(12) United States Patent
Heller et al.

(10) Patent No.: US 7,100,502 B2
(45) Date of Patent: Sep. 5, 2006

(54) DEVICE FOR FIXING A COVER ON A CYLINDER OF A PRINTING UNIT

(75) Inventors: Albert Heller, Pestenacker (DE); Georg Kässmair, Zusamzell (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/505,745

(22) PCT Filed: Feb. 22, 2003

(86) PCT No.: PCT/EP03/01816

§ 371 (c)(1),
(2), (4) Date: Aug. 24, 2004

(87) PCT Pub. No.: WO03/072359

PCT Pub. Date: Sep. 4, 2003

(65) Prior Publication Data

US 2005/0139107 A1 Jun. 30, 2005

(30) Foreign Application Priority Data

Feb. 26, 2002 (DE) ..... 102 08 262

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS

| | | | | |
|---|---|---|---|---|
| 2,157,621 | A * | 5/1939 | Neilson | 101/415.1 |
| 2,621,592 | A | 12/1952 | Faeber | |
| 4,068,586 | A * | 1/1978 | Frey et al. | 101/415.1 |
| 4,104,968 | A * | 8/1978 | Schwaab et al. | 101/415.1 |
| 5,454,316 | A | 10/1995 | Ohta et al. | |
| 5,644,984 | A | 7/1997 | Puschnerat et al. | |
| 5,749,299 | A | 5/1998 | Barrois et al. | |
| 5,778,786 | A | 7/1998 | Metrope | |
| 5,809,890 | A | 9/1998 | Knauer et al. | |
| 6,019,043 | A | 2/2000 | Knauer et al. | |
| 6,231,490 | B1 * | 5/2001 | Speil et al. | 492/25 |
| 6,612,239 | B1 * | 9/2003 | Reichel et al. | 101/415.1 |
| 2005/0193910 | A1 * | 9/2005 | Schmid | 101/415.1 |

FOREIGN PATENT DOCUMENTS

| | | |
|---|---|---|
| DE | 641 173 | 1/1937 |
| DE | 23 34 127 A1 | 1/1975 |
| DE | 40 35 621 A1 * | 6/1991 |
| DE | 195 09 563 A1 | 9/1996 |
| DE | 196 19 941 A1 | 1/1997 |
| DE | 195 37 420 C1 | 3/1997 |
| DE | 197 01 046 A1 | 7/1997 |
| DE | 199 22 021 A1 | 11/2000 |
| EP | 0 418 991 A2 | 3/1991 |

* cited by examiner

*Primary Examiner*—Leslie J. Evanisko
(74) *Attorney, Agent, or Firm*—Cohen, Pontani, Lieberman & Pavane

(57) ABSTRACT

To provide a device for fixing a covering to a printing-unit cylinder in which, while implementing a narrow gap in the cylinder circumferential surface, the legs of the covering can be tensioned easily and reliably, a spindle bears a trailing channel edge of a tension channel the trailing channel edge can be moved away from the leading channel edge by pivoting the spindle.

9 Claims, 4 Drawing Sheets

DEVICE FOR FIXING A COVER ON A CYLINDER OF A PRINTING UNIT

PRIORITY CLAIM

This is a U.S. national stage of application No. PCT/EP2003/001816, filed on 22 Feb. 2003. Priority is claimed on that application and on the following application(s): Country: Germany, Application No.: 102 08 262.6, Filed: 26 Feb. 2002.

BACKGROUND OF THE INVENTION

1. Field of the Invention

The invention relates to a device for fixing a covering to a printing-unit cylinder of a printing machine.

2. Description of Prior Art shows a device for fixing a flexible printing plate to a forme cylinder. The device has a spindle arranged in a cylinder channel. The printing plate to be tensioned is hooked in with its angled-over leading leg on a leading channel edge and wound around the forme cylinder. The angled-over trailing leg is then inserted into the tensioning channel and plugged into a slot in the spindle. When the spindle is rotated, it presses the leading leg against a channel wall and pulls the trailing leg into the tensioning channel.

The device has a trailing leg of complicated shape, a broad gap in the cylinder circumferential surface being required for its insertion into the tensioning channel. This necessitates a corresponding loss in cylinder circumferential surface, which is not available for a print and manifests itself in unprintable, white margins. Furthermore, a wide gap causes oscillations during printing.

SUMMARY OF THE INVENTION

It is an object of the invention to provide a device for fixing a covering to a printing-unit cylinder in which, while implementing a narrow gap in the cylinder circumferential surface, the legs of the covering can be tensioned easily and reliably.

According to the present invention, a device for fixing a covering to the printing-unit cylinder, the covering having a leading angled-over leg and a trailing angled-over leg, comprises a leading channel edge of a tensioning channel defined in the printing-unit cylinder along an axial direction of the printing-unit cylinder for hooking the leading angled-over leg of the covering, and a spindle arranged in the printing-unit cylinder and running along the axial direction of the printing-unit cylinder. The spindle is pivotable to a tensioning position for tensioning the trailing angled-over leg of the covering. Furthermore, the spindle accommodates a trailing channel edge of the tensioning channel, wherein the spindle is pivotable away from the tensioning position for moving the trailing channel edge away from the leading channel edge. By virtue of the ability of the trailing channel edge to be moved back, a narrow channel can be implemented during printing operation and a broad channel when the covering is changed. This permits the use of a simply shaped leading and trailing leg, which can be inserted easily into the tensioning channel. This makes it possible to change a covering automatically. In addition, a very narrow gap in the cylinder circumferential surface can be implemented, as a result of which the loss of area, which is not available for the print, is small. Furthermore, oscillations, channel impacts as they are known, are reduced, which provides preconditions for good printing quality. Further features and advantages emerge from the subclaims in conjunction with the description.

BRIEF DESCRIPTION OF THE DRAWINGS

The invention will be explained in more detail below using an exemplary embodiment. In the drawings.

DETAILED DESCRIPTION OF THE PREFERRED EMBODIMENTS

Figure 1:
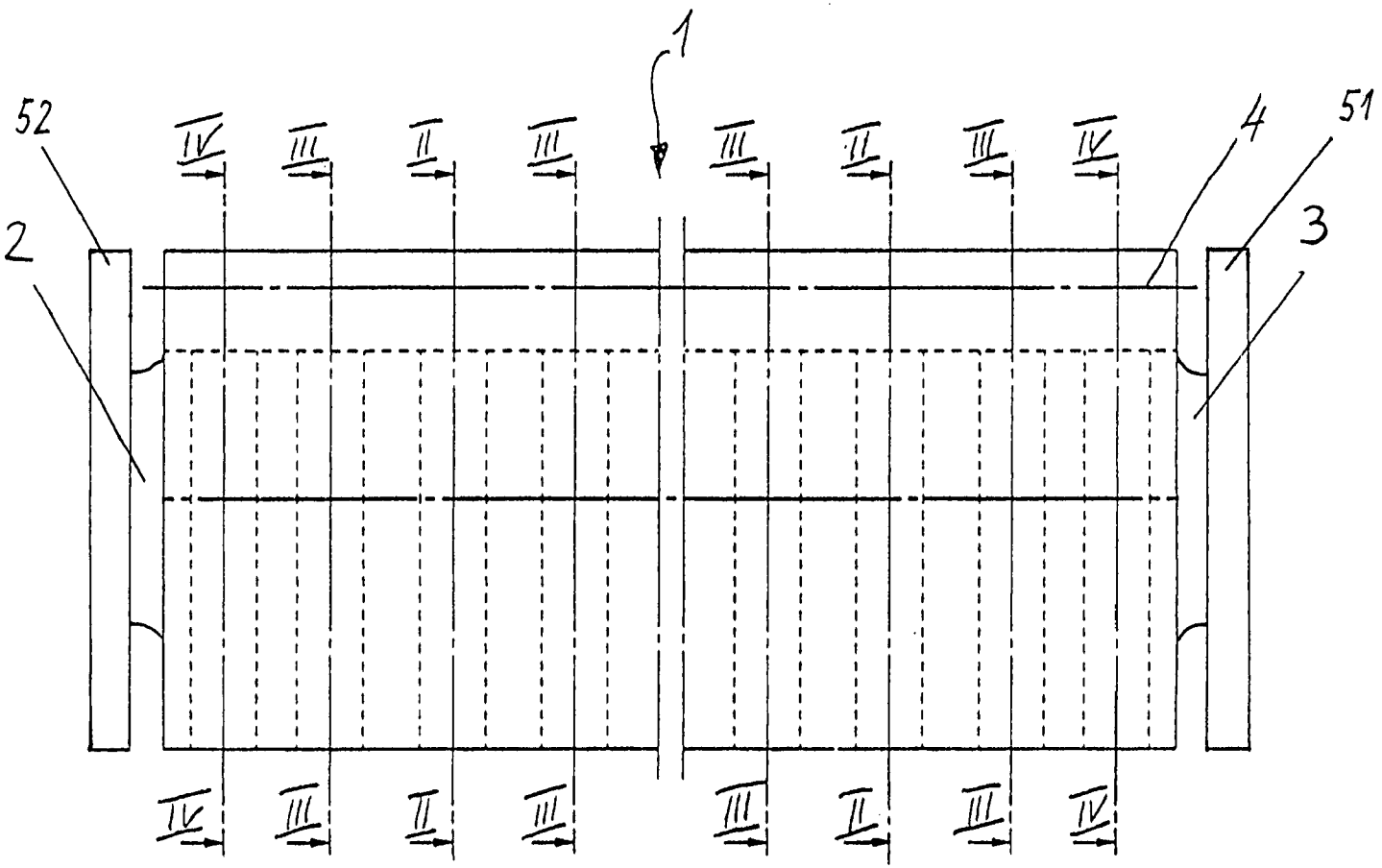
FIG. 1 is a side view of a form cylinder according to the invention.

The forme cylinder 1 shown in FIG. 1 is mounted in side walls by its journals 2, 3 (the sidewalls are not illustrated). A spindle 4 is mounted in the forme cylinder 1, running in the axial direction of the latter. The spindle 4 has a recess which, together with a channel wall 5 of the forme cylinder 1, forms a tensioning channel 6 (e.g. FIG. 4). The channel wall 5 runs at an acute angle to the circumferential surface of the forme cylinder 1 and, at the point of intersection with the latter, forms a leading channel edge 7. The spindle 4 accommodates a trailing channel edge 8, adjacent to which the spindle has a face 9 with which a circumferential area of the forme cylinder 1 may be represented.

Figure 3:
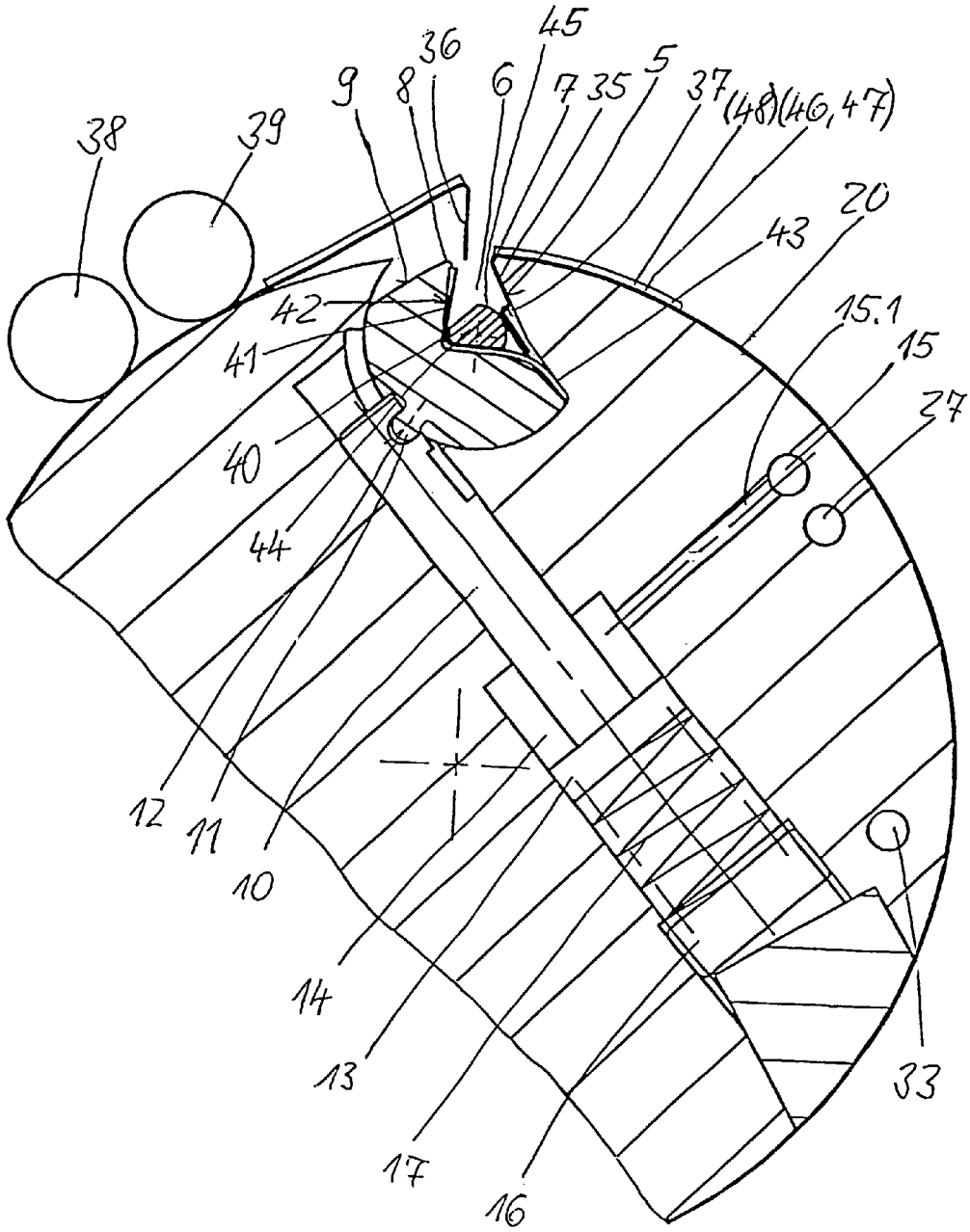
FIG. 3 is a sectional view along line III—III from FIG. 1.

The spindle 4 is rotatably mounted in the body of the forme cylinder 1 and can be pivoted over a range by a drive. One drive variant is illustrated in FIG. 3. In detail, the spindle 4 makes a toothed form fit with a push rod 10. The spindle 4 bears a lug 11 which engages in a spherical hole 12 in the push rod 10. As an alternative, the spindle 4 could also bear a toothed segment which engages with a rack on the spindle 10. Fixed to the push rod 10 is piston 13 which can be displaced in a bore 14 in the forme cylinder 1. The piston 13 and the bore 14 form an operating cylinder which can be fed with compressed air via lines 15 and 15.1. When fed with compressed air, the piston 13 is acted on accordingly and, together with the push rod 10 and the spindle 4, assumes the position shown in FIG. 3. In the process, a compression spring 17 supported on a plug 16 is stressed. When the compressed air is switched off, the compression spring 17 displaces the piston 13 in the now unpressurized pressure chamber in the bore 14, the spindle 4 being pivoted in the clockwise direction. In the process, the spindle 4 is pivoted into the end position shown in FIG. 4, in which a lug 18, designed for example as a key, strikes the end of a recess 19 in the cylinder body. The spindle drive described is advantageously arranged many times on the spindle 4, for example twice in the exemplary embodiment.

Figure 2:
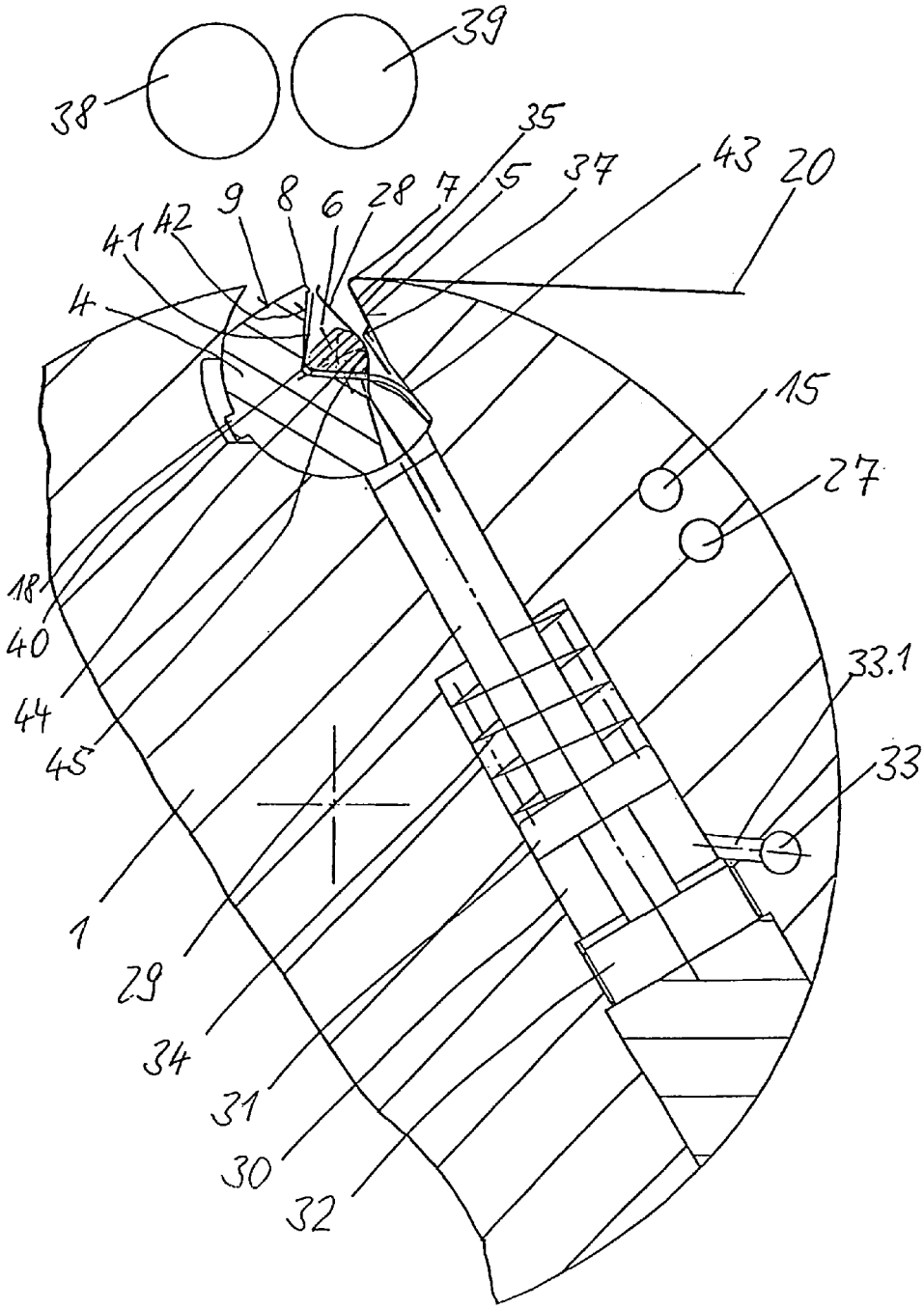
FIG. 2 is a sectional view along line II—II from FIG. 1.
Figure 4:
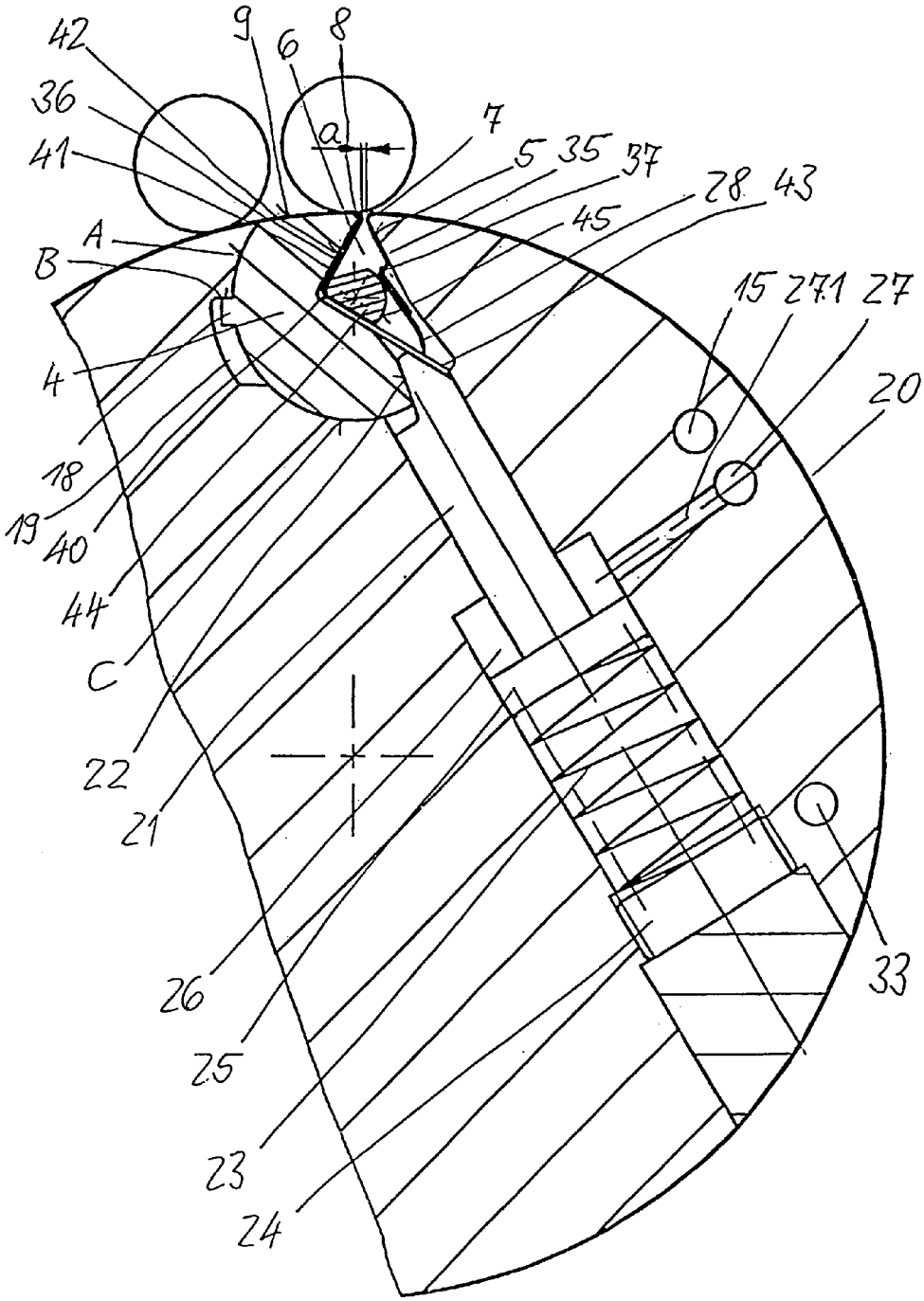
FIG. 4 is a sectional view along line IV—IV from FIG. 1.

The stop position of the spindle 4, shown in FIG. 4, is the tensioning position for the printing forme 20 (also referred to as printing plate 20), to be tensioned. In this tensioning position, the spindle 4 is blocked by a wedge 21, as shown in FIG. 4. For this purpose, the wedge 21 is moved against a wedge face 22 on the spindle 4. This is done by the force of a compression spring 23, which is supported against a plug 24 in the cylinder body and against which there presses a piston 25 which is fixed to the wedge 21. Together with a bore 26, the piston 25 forms an operating cylinder. The bore 26 can be filled with compressed air via lines 27 and 27.1. When pressure is applied to the piston 25 in this case, the latter is moved together with the wedge 21 counter to the force of the compression spring 23, it being possible for the wedge 21 to be brought out of contact with the wedge face 22 and for the blocking of the spindle 4 to be cancelled. A plurality of the above-described blocking devices may be provided on the spindle 4. In addition, one or more spring hooks 28, two spring hooks 28 in the exemplary embodiment, can be moved in the tensioning channel 6 (FIG. 2). The spring hook 28 is fixed to a piston rod 29, which is connected to a piston 31 that can be displaced in a bore 30. The bore 30 and the piston 31 form an operating cylinder whose pressure chamber is closed by a plug 32 and can be fed with compressed air via lines 33 and 33.1. When the pressure chamber is fed with compressed air, the piston 31 together with piston rod 29 and spring hook 28 assume the position shown in FIG. 2, a compression spring 34 supported at the bottom of the bore 30 being stressed. When the compressed air is switched off, that is to say when the pressure chamber on the piston 31 is depressurized, the force of the compression spring 34 effects a movement of the piston 31 towards the plug 32, the spring hook 28 being pulled into the tensioning channel 6.

The tensioning of the flexible printing forme 20 is carried out by the latter first being hooked in with its leading angled-over leg 35 on the leading channel edge 7 of the forme cylinder 1. The spindle 4 and the spring hook 28 are in this case in the positions shown in FIG. 2. For this purpose, the push rod 10 of the spindle drive inherently has the position shown in FIG. 3, and the piston rod 29 bearing the spring hook 28 inherently has the position shown in FIG. 2. In this spindle position, the tensioning channel 6 is open wide, and it is easily possible to insert the leading leg 35 (and subsequently the trailing leg 36) of the printing forme 20. The compressed-air supply to the bore 30 is then switched off (FIG. 2) as a result of which the compression spring 34 moves the piston on to the plug 32, and the spring hook 28 is pulled into the tensioning channel 6. In the process, it is placed on a notch 37 in the leading leg 35 and pulls the leading leg of the printing forme 20 into the tensioning channel 6 and brings the printing forme 20 with its angled-over edge into contact with the leading channel edge 7. The printing forme 20 is aligned well with the leading channel edge 7 in the process. Alignment by hand, for example by tapping, is rendered superfluous. Good alignment is important for the following correct-position mounting. In the exemplary embodiment, the notch 37 is designed in the manner of a step. It could also be shaped in a V, for example.

The printing forme 20 hooked in at the leading channel edge 7 and firmly clamped on the latter by means of the spring hook 28 is subsequently wound around the forme cylinder 1 (FIG. 3). In the process, one or more pressure rolls 38, 39 press the printing forme 20 firmly on to the forme cylinder 1. Instead of this, an adjacent transfer cylinder can also be brought into rolling contact with the forme cylinder 1. Towards the end of a rolling revolution, the area of form cylinder 1 in which the spindle 4 is arranged approaches the pressure rolls 38, 39, the trailing leg 36 pivoting into the tensioning channel 6 (FIG. 3).

With the tensioning channel 6 opened in the spindle position shown, the pivoting-in action is easily possible. In addition, the point of rotation of the spindle 4 in the body of the forme cylinder 1 is arranged in such a way that the trailing channel edge 8 on the spindle 4 and the face 9 of the spindle do not emerge beyond the circle of the forme cylinder 1. As a result, it is possible to plug the leading leg completely into the tensioning channel 6. The trailing edge 36 plugged in comes to rest on a stop 40 on the spindle 4. In addition, one or more leaf springs 41 arranged beside one another are placed in front of the trailing channel edge 8 (FIG. 3). These leaf springs 41 engage behind the trailing leg 36 hooked in on the trailing channel edge 8 and supported on the stop 40. The spindle 4 is then rotated into the tensioning position (FIG. 4) by switching off the compressed air in the bore 14, the leaf springs 41 being moved elastically on to the spindle wall 42 adjacent to them and being prestressed. During printing operation, the prestressed leaf springs 41 hold the trailing plate end under tension and retention the printing plate 20. The printing plate 20 has now been tensioned and the pressure rolls 38, 39 can be set off.

The device has the advantage that the tensioned printing plate 20 is not held by compressed air, but that instead the tensioning function is maintained by the compression springs 17, 23 and 34. As a result, the tensioning device is secure against accidents in the event of compressed-air failures. In addition, no compressed air needs to be supplied during printing operation, as a result of which friction losses in rotary inlets are minimized. The pressure fluid used can, for example, also be oil. The fluid is advantageously supplied to the lines 15, 27, 33 via lines in the journals 2, 3. It is also advantageous that the leading leg 35 and trailing leg 36 can be tensioned independently of each other by separate means. As a result, the leading leg 35 and the plate start can be held during the entire pulling-on operation. Reverse rotations of tensioning means and also of the forme cylinder are not required. The tensioning operation can be carried out with a single revolution of the forme cylinder 1. This manifests itself in a time saving and permits rapid tensioning of the printing forme 20.

The removal of the printing forme 20 is carried out in the reverse sequence to its mounting. First of all, the forme cylinder 1 is rotated into the position shown in FIG. 3 with respect to the pressure rolls 38 and 39, the latter being set on. At the same time or thereafter, the blocking of the spindle 4 is cancelled by compressed air being applied to the piston 25 by supplying compressed air via the line 27 and 27. 1, and said piston being pulled back counter to the force of the compression spring 23 (FIG. 4). The spindle 4 is then pivoted into the position shown in FIG. 3 by compressed air being applied to the piston 13 via the lines 15 and 15.1 and said piston being pulled back counter to the force of the compression spring 17. The trailing end of the printing forme 20, together with the trailing leg 36, then springs out of the tensioning channel 6. During the further rotation of the forme cylinder 1 in the clockwise direction, the printing forme 20 is unwound from the forme cylinder 1 and can be lifted off the leading channel edge 7 in the position shown in FIG. 2. Previously, however, the spring hooks 28 still have to be shifted into the position shown in FIG. 2. For this purpose, compressed air is applied to the piston 31 via the lines 33 and 33.1, the piston 31 moving upwards counter to the force of the compression spring 34, the spring hook 28 likewise moving and releasing the notch 37 in the leading leg 35.

Arranged in the cylinder channel 6 is a dirt cover 43, which protects the deeper areas against contamination. The dirt cover 43 is advantageously screwed to the spindle 4 by a profiled strip 44, if necessary subdivided into portions. The profiled strip 44 advantageously also bears the stop 40 and a rounded portion 45, with which the spring hook 28 acting on the notch 37 is prevented from bending out (FIG. 2). The tensioning channel 6 may be cleaned easily as a result of its possible wide opening. In addition, the individual parts of the device are easily accessible. The spindle 4 can be mounted outside the area of Schmitz (bearer) rings 51, 52, which allows the spindle 4 to be removed radially from the forme cylinder 1, which makes simple maintenance and, if necessary, repair possible.

Furthermore, the device does not require any large, complicated mountings for the spindle 4, since the latter, in the tension state, is mounted in a bore in the forme cylinder 1 reliably and without the risk of bending, and is supported at the points A, B and C and on wedge 21 when in the blocked position (FIG. 4). Only small mountings (not illustrated) are provided at the ends on the cylinder circumference or in the edge regions of the latter, without any qualitative requirements on bearing quality, in order to secure the opened spindle 4. This, and also the arrangement of the spindle 4 in the circumferential area and its drive in the interior of the forme cylinder 1, permit the journals 2, 3 to be designed with a large diameter and to keep the dimension between the printing-unit walls small, or to design the cylinder bodies to be wide. If appropriate, assisting this, the Schmitz rings can also be dispensed with. The result, overall, is that high rigidity of the printing-unit cylinder can be achieved.

The device can be employed for many printing-machine types and at the same time in each case for the smallest to the largest formats. Changing a printing forme can be implemented manually, semiautomatically or fully automatically. By virtue of simple configuration of the leading and trailing legs 35, 36, no special requirements are placed on the preceding systems for printing-plate production, for example edge-angling devices. The angled-over edges can be produced simply and reliably, for example whilst maintaining close tolerances, even relatively small section lengths being feasible. Punched holes can also be introduced.

In the operating state, the channel in the cylinder circumferential surface can be closed apart from a very small distance a (FIG. 4), to be specific virtually as far as contact between the printing-forme angled-over edges. The distance between the leading and trailing channel edges 7, 8 can thus be dimensioned to be approximately of the size of twice the printing plate thickness. This permits the non-printing area to be minimized in the extreme and the implementation of a large image size. In addition, the excitation of oscillations by channel impacts is reduced, and thus the achievable print quality is improved.

Using the device, rubber blanket units 46 can also be tensioned. One such is also shown by thin lines in FIG. 3, the item numbers being specified in brackets. The rubber blanket unit 46 includes a carrier plate 47, on which a rubber blanket 48 is fixed, with the exception of the leading and trailing legs. The legs are tensioned in the device in an analogous way to those of the printing forme 20.

The invention can also be used when a plurality of tensioning channels 6 are arranged on the circumference of the printing-unit cylinder 1, into which in each case a leading and a trailing leg 35, 36 of two adjacent coverings 20, 46 to be fixed can be plugged.

What is claimed is:

1. In a printing-unit cylinder of a printing machine, a device for fixing a covering to the printing-unit cylinder, the covering having a leading angled-over leg and a trailing angled-over leg, said device comprising:

a leading channel edge of a tensioning channel defined in the printing-unit cylinder along an axial direction of the printing-unit cylinder for hooking the leading angled-over leg of the covering; and a spindle arranged in the printing-unit cylinder and running along the axial direction of the printing-unit cylinder, said spindle being pivotable about a pivoting axis to a tensioning position for tensioning the trailing angled-over leg of the covering, said spindle accommodating a trailing channel edge of the tensioning channel, wherein said spindle is pivotable away from the tensioning position for moving the trailing channel edge away from the leading channel edge, and wherein said spindle is mounted outside the area of Schmitz rings such that said spindle is radially removable from the printing-unit cylinder, the printing-unit cylinder defining a circumferential area on an outer circumferential surface of the printing-unit cylinder, said pivoting axis of said spindle being arranged such that said trailing channel edge remains radially within a circumference defined by the outer circumferential surface during pivoting of said spindle toward and away from said tensioning position, said spindle further defining a face adjoining the trailing channel edge, said face forming a part of the circumferential area when said spindle is in said tensioning position.

2. The device of claim 1, wherein said spindle defines a stop against which the trailing angled-over leg is receivable.

3. The device of claim 1, further comprising at least one leaf spring arranged in front of the trailing channel edge, said spindle bearing said at least one leaf spring.

4. The device of claim 1, further comprising at least one spring hook arranged in said tensioning channel, said spring hook being movable for pulling the leading angled-over leg onto the leading channel edge.

5. The device of claim 1, further comprising a push rod connected to said spindle by a drive connection, said push rod being drivable by a drive for pivotally displacing said spindle.

6. The device of claim 1, further comprising at least one wedge which is movable against a wedge face on the spindle for blocking the spindle in the tensioning position.

7. The device of claim 1, further comprising a dirt cover arranged in the tensioning channel for blocking the ingress of dirt past the spindle into the printing-unit cylinder.

8. The device of claim 1, wherein the covering comprises one of a printing forme and a rubber blanket unit having a rubber blanket fixed to a carrier plate.

9. The device of claim 1, wherein said face on said spindle does not move radially outside of the outer circumferential surface during pivoting toward and away from said tensioning position.

* * * * *